United States Patent [19]

Budich

[11] 4,040,219

[45] Aug. 9, 1977

[54] PROFILE ARRANGEMENT FOR WINDOW FRAMES OR DOORFRAMES

[75] Inventor: Wolfgang Budich, Troisdorf-Eschmar, Germany

[73] Assignee: Dynamit Nobel Aktiengesellschaft, Germany

[21] Appl. No.: 628,370

[22] Filed: Nov. 3, 1975

[30] Foreign Application Priority Data

Nov. 2, 1974 Germany ..... 2452087
Nov. 2, 1974 Germany ..... 2452089

[51] Int. Cl.[2] ..... E06B 7/14; E06B 3/58

[52] U.S. Cl. ..... 52/209; 52/309.1; 52/397; 52/501; 52/732

[58] Field of Search ..... 52/198, 397, 398, 399, 52/498, 499, 501, 209, 616, 731, 732, 235, 309.1

[56] References Cited

U.S. PATENT DOCUMENTS

| | | | |
|---|---|---|---|
| 3,475,870 | 11/1969 | Birum | 52/498 |
| 3,751,868 | 8/1973 | Mascioletti | 52/235 |

FOREIGN PATENT DOCUMENTS

| | | | |
|---|---|---|---|
| 2,219,268 | 10/1973 | Germany | 52/731 |
| 2,263,990 | 7/1973 | Germany | 52/397 |
| 1,222,145 | 2/1971 | United Kingdom | 52/397 |

*Primary Examiner*—John E. Murtagh
*Attorney, Agent, or Firm*—Craig & Antonelli

[57] ABSTRACT

A profile arrangement for window frames or doorframes which includes Z-shaped, T-shaped or L-shaped profile members serving as either a blind frame element or a sash frame element. The profile members are provided with at least one projecting centrally disposed tongue portion on one side thereof which serves as a receptor for either a sealing element or for receiving a portion of a glass molding member having a hollow chambered cross-sectional configuration. The profile members include a number of hollow chambers at least one of which may be provided with a metallic insert to increase the reinforcement of the profile members. A glass molding element is provided which includes a projecting cam portion which is adapted to interengage with the projecting tongue portion of the profile members to fix a glazing to the respective profile member.

67 Claims, 9 Drawing Figures

PROFILE ARRANGEMENT FOR WINDOW FRAMES OR DOORFRAMES

The present invention relates to a profile member, and more particularly to a profile member for window frames or doorframes with the profile member having a Z-shaped, L-shaped, or T-shaped cross-sectional configuration. The profile member is formed of a thermoplastic synthetic resin and has a hollow-chamber cross-section with metallic profiles being insertable into at least one of the hollow chambers for increasing the rigidity of the profile member.

For the formation of window frames or doorframes, various profile members are required for fixed installation in the wall, in a soffit, or for use in movable sashes. Specifically, the fixedly installable profile members must be fashioned so as to be adaptable to one another on the side facing the movable profile members in order to ensure efficient functioning.

Hollow chamber profile members of a thermoplastic synthetic material with or without reinforcing metal inserts have been proposed and applied in various constructions; however, these proposed profile members, due to their configuration, lack the requisite versatility for adapting them to various different functions and also are somewhat difficult to install.

Additionally, glass moldings or glass holding fillets for mounting the glass panes at the frame element, for example, for windows or doors, have been proposed and have an approximately U-shaped configuration which is resiliently compressible in a groove or the like formed by tongues, protrusions, or webs at the frame profile; however, the proposed glass moldings do not ensure a mounting of the glazing so as to prevent the occurrence of a tilting movement thereby leading to a loosening of the glazing at the frame.

The present invention is concerned with the task of providing a structurally simple profile member and glass molding member which eliminates the aforementioned shortcomings encountered in the prior art.

The underlying problems are solved in accordance with the present invention in that a hollow profile member is provided having a substantially Z-shaped, T-shaped or L-shaped cross-sectional configuration and in that the glass moldings are fashioned as hollow-chambered moldings adapted to be fastened to the respective profile members.

According to one feature of the present invention, one side of a profile member is formed with a tongue or projection arranged unilaterally at the profile core cross-section with the tongue or projection being bent twice at an angle to form an undercut groove. On the side of the profile member facing away from the bend of the tongue, a projection fashioned as a hollow chamber is provided leaving a channel in the extension of the lateral boundary of the core cross-section. The projection is provided at its end with inwardly oriented undercut grooves. This identical configuration is provided along one side of the Z-shaped, L-shaped, or T-shaped profile member. By virtue of this construction the objective is obtained that the profile members are insertable as the blind frame and can be glazed just as well as the profile members insertable as the sash with the twice-angled tongue or projection serving selectively for either receiving a glass molding or a central seal element. Preferably according to the present invention the tongue is arranged centrally at the core cross-section of the profile members.

According to a further feature of the present invention, depending on the structure or configuration of the central seal insertable at the blind frame, the wall of the core cross-section can be recessed oppositely of a groove formed by the angled tongue or projection thereby forming a further identical groove. The two grooves are so arranged that a hammerhead-shaped groove is obtained for receiving the central seal and anchoring the same on both sides thereof.

According to yet another feature of the present invention, it is possible to utilize the Z-shaped profile members for both a sash profile member and a blind frame profile member; to utilize the L-shaped profile member as a blind frame profile member; and to utilize the T-shaped profile member as a sash profile member, a blind frame profile member, a supporting element or abutment, or a positioning element.

Additionally, in accordance with the present invention, the provision of the twice-angled tongue, preferably arranged centrally on one side of the profile members offers the possibility of making it possible in an especially advantageous fashion to insert a glass molding member horizontally.

A further feature of the present invention resides in the fact that the core-cross-section of the profile members is fashioned in each case with a main hollow chamber in the middle or center of the profile members with the hollow chamber being separated by webs from two lateral hollow chambers. The web of one of the lateral hollow chambers serves for the additional mounting of fittings and the hollow chamber formed by the second web serves for drainage purposes. This construction ensures that the sash profile members and the blind profile members are provided with drainage chambers which are in communication with a channel formed between the angled tongue and glazing projection.

According to yet another feature of the present invention, the lateral boundary of the core cross-section of the profile members on the side facing the angled section of the tongue can be formed by a projecting cam which preferably is provided with an undercut and which serves, on the one hand, for supporting any optionally present fittings and, on the other hand, can be utilized as the abutment surface for the sealing profile elements.

Additionally, in order to ensure the ready adaptation of different functions of the L-shaped, Z-shaped, and T-shaped profile members, in accordance with the present invention the sides of the respective profile members oppositely to the identically fashioned sides of the L-shaped, Z-shaped, and T-shaped profile members are fashioned to be different from one another. Specifically, the Z-shaped profile member is provided, in the zone opposite the tongue at the core cross-section, with a deep groove for receiving fittings between the externally disposed abutment projection and the inclined supporting cam. Preferably the supporting cam is provided with a beveled or inclined end portion which lies in the range of 5° to 15° whereby the beveled portion forms an advantageous supporting surface for a central seal while simultaneously defining the groove for receiving the fittings.

According to yet another feature of the present invention, the T-shaped profile member is fashioned to by symmetrical so that it can be installed as a blind frame member, a sash frame member, an abutment, or a positioning element with the angled tongue thereof serving selectively for receiving a central seal or a glass molding.

Furthermore, it is possible to produce with the T-shaped profiles members in accordance with the present invention blind frames provided with inwardly or outwardly opening wings, fixed sub-divisions, and similar other arrangements.

According to a feature of the glass molding members in accordance with the present invention a holding cam is formed at the end of a tongue extended at a slight angle from a tongue of the glass molding extending from the contact surface of the glass molding and in parallel along the frame profile. By virtue of the construction of the holding cam at the end of an inclined tongue, it is possible to insert the tongue, by slightly inclining the glass molding in parallel to the frame profile, in a groove or the like formed at the frame profile, and by effecting a hook-like engagement with the frame profile member by subsequently slightly inclining the holding cams of the glass molding. Furthermore, after assemblying the glass molding member in a frame profile member, a constant glazing pressure is exerted by the glass panes to constantly maintain the connection thereby making it impossible for the holding cam to tilt backwards and unhook itself. Consequently, by providing the glass molding members according to the present invention, a parallel insertion with respect to the frame member is made possible with the glazing pressure permanently maintaining, in a simple manner, the claw-like or hook-like connection interlocking the glass molding member with the frame profile member over the entire length thereof.

According to still another feature of the present invention, in spacing of the holding cam from a basal plane of the tongue, effected by the angled configuration of the tonge, is at least as large as, and preferably in all cases somewhat larger than the height of an abutment formed by the holding cam for interlocking the glass molding member with a frame member.

According to a further feature of the glass moldings in accordance with the present invention such moldings may be extruded from a thermoplastic synthetic resin with each of the moldings advantageously being fashioned as a hollow profile member with a closed chamber. However, it is also possible to make the glass molding chambers of the present invention of another suitable material.

By fashioning the glass molding member of the present invention as a closed hollow profile, according to a further feature of the present invention the tongue fashioned with the holding cam projects in an extension of a tongue forming the contact surface at the frame member laterally beyond the hollow chamber of the glass molding. The point where the angled tongue is bent away from the base tongue structure is preferably arranged in the zone of the hollow chamber of the glass molding. The length of the angled tongue of the glass moldings is dependent upon the dimensions of the frame profile members as well as dependent upon the dimensions of the particular glazing to be utilized. The size of the angled bend of the tongue carrying the holding cam preferably is approximately 10°; however, the angle of the bend is also dependent on the required spacing of the holding cam from the contact surface at the frame profile member.

A further feature of the present invention resides in arranging the bending point or elbow of the angled tongue of the glass molding members in the zone of the hollow chambered portion thereof so that a tipping or tilting movement when the glass pane is inserted cannot occur thereby avoiding a loosening of the glass pane. The precluding of the tilting moment is accomlished in accordance with the present invention by providing a cam on the side of the glass molding member facing the glazing which cam is formed as an extension of the wall of the molding member disposed oppositely to the angled tongue thereof with the spacing of the cam from the glazing to be retained being less than the spacing from the bending point or elbow of the angled tongue to the glazing pane. The cam receives a sealing profile element which is supported against the glass pane; however, by providing a smaller distance between the cam and the glazing plane as compared to the distance between the bending point of the tongue and glazing plane, the tipping moment of the glass molding cannot be triggered whereby the glass molding is mounted on the profile member in a stably interlocked condition.

To facilitate the introduction of glass moldings, a further feature of the present invention provides a beveling or rounding off of the top side of the holding cam and a beveled or rounding off of the corresponding tongue and of the tongue forming the groove at the frame profile members.

According to the present invention the glass molding members are utilized preferably in conjunction with the T-shaped, Z-shaped, or L-shaped profile members extruded from preferably thermoplastic synthetic resins with the profile members including at least unilaterally at the core cross-section a groove formed by a centrally arranged and twice-angled tongue adapted to form a hook-like engagement with the holding cam of the glass molding member.

Accordingly, it is an object of the present invention to provide profile members and glass holding members which avoid, by simple means, the aforementioned drawbacks and shortcomings encountered in the prior art.

Another object of the present invention resides in providing profile members and glass holding members which are relatively simple in construction and relatively inexpensive to manufacture.

A further object of the present invention resides in providing profile members for window frames or doorframes which are made of a thermoplastic synthetic resin and which consist of main profile members having a Z-shaped, L-shaped, and T-shaped cross-sectional configuration with all of the profile members being readily combinable with each other and readily installable in arrangements having differing functions.

Still another object of the present invention resides in providing a glass molding or glass holding fillet for fixing the glazing in frames of windows or doors formed from profile members which molding hooks by means of a mounting or holding cam into a groove, undercut or the like formed by a projection provided at the frame profile members.

Still another object of the present invention resides in providing a molding member which simplifies the glazing of the frames for windows or doors by providing that the glass molding can be inserted in a direction parallel to the frame profile members.

Yet another object of the present invention resides in a glass molding member which avoids the occurrence of a tilting movement of the glazing thereby precluding the loosening of the glazing from the frame member.

These and further objects, features and advantages of the present invention will become more apparent from the following description when taken in connection with the accompanying drawing which shows, for the purposes of illustration only, several embodiments in accordance with the present invention, and wherein.

Figure 1:
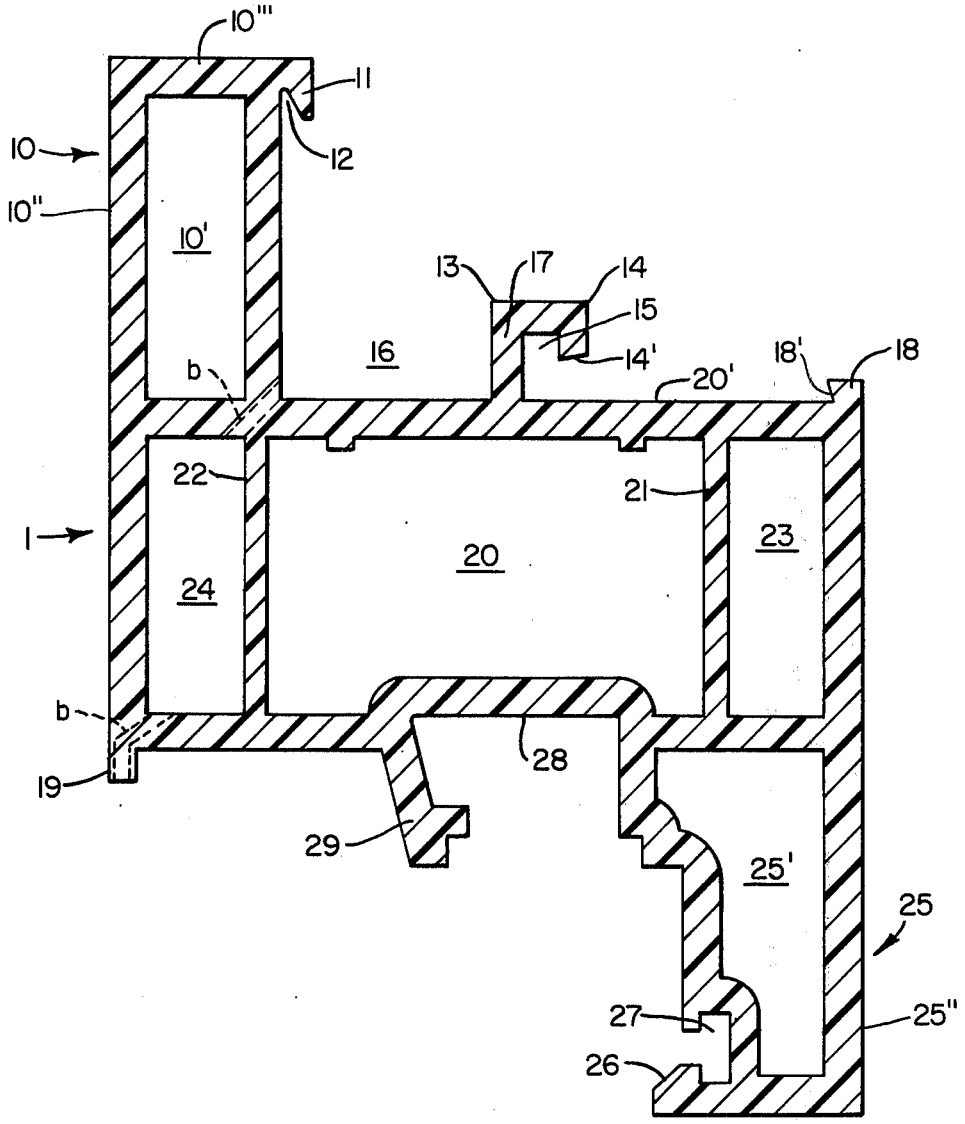
FIG. 1 is a cross-sectional view of a Z-shaped profile member in accordance with the present invention.
Figure 3:
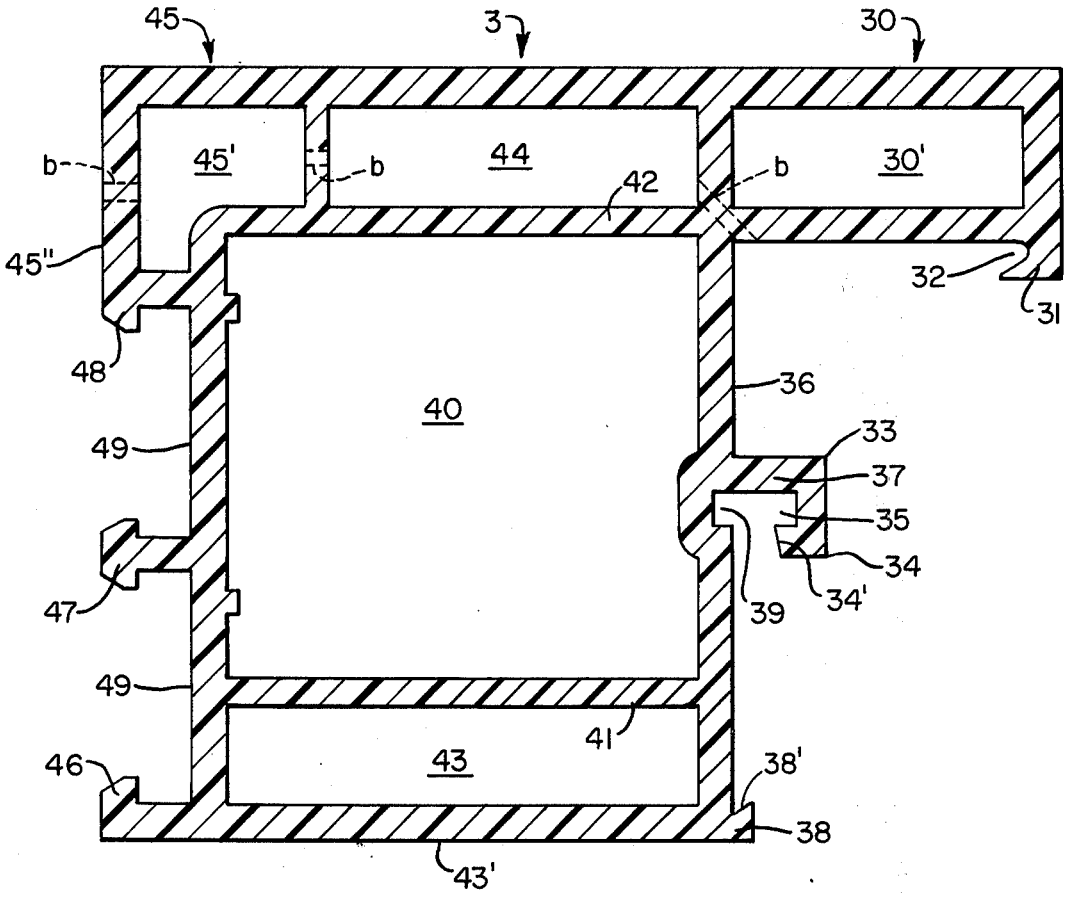
FIG. 3 is a cross-sectional view of an L-shaped profile member in accordance with the present invention.
Figure 4:
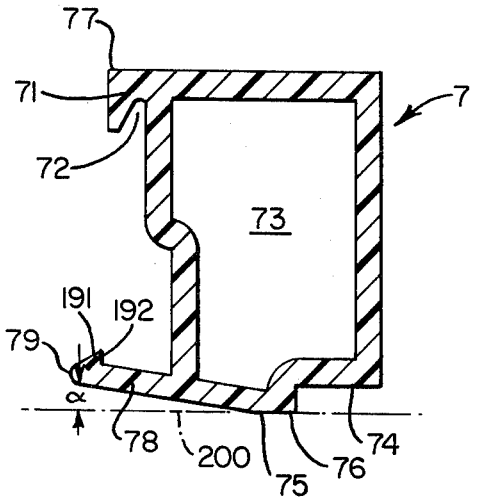
FIG. 4 is a cross-sectional view of a glass molding for a thick glass pane in accordance with the present invention.
Figure 5:
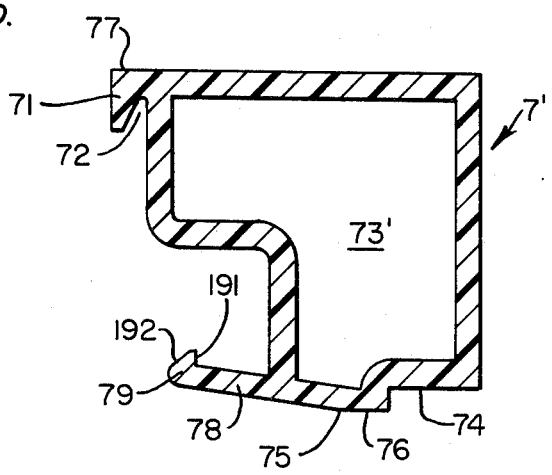
FIG. 5 is a cross-sectional view of a glass molding for normal glass panes in accordance with the present invention.
Figure 6:
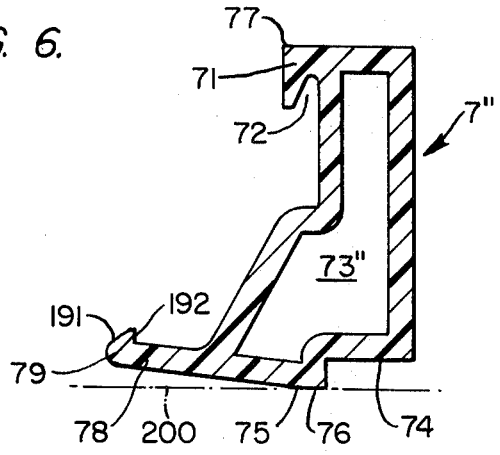
FIG. 6 is a cross-sectional view of a glass molding for insulated glass panes in accordance with the present invention.
Figure 7:
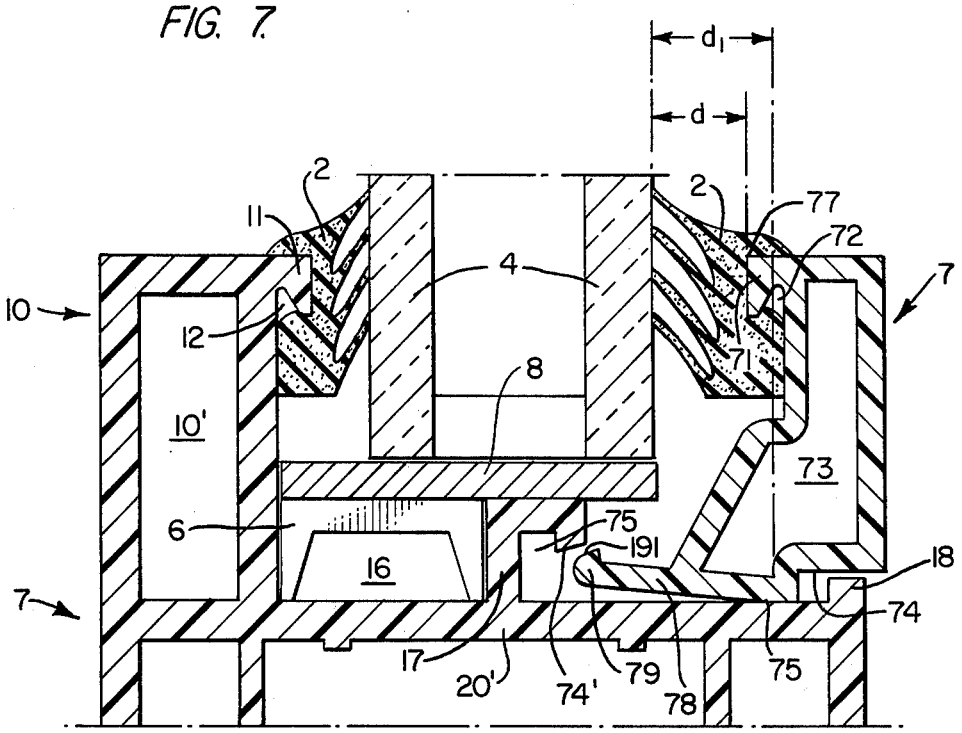
FIG. 7 is a cross-sectional view through a portion of the profile member of FIG. 1 and glass molding of FIG. 4 as the glass molding is being attached to the profile member.
Figure 8:
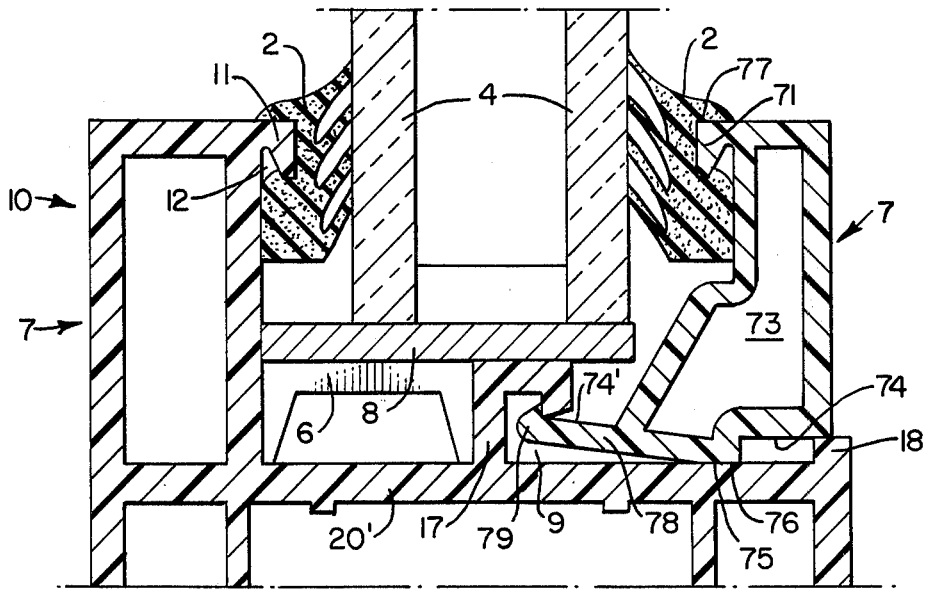
Figure 9:
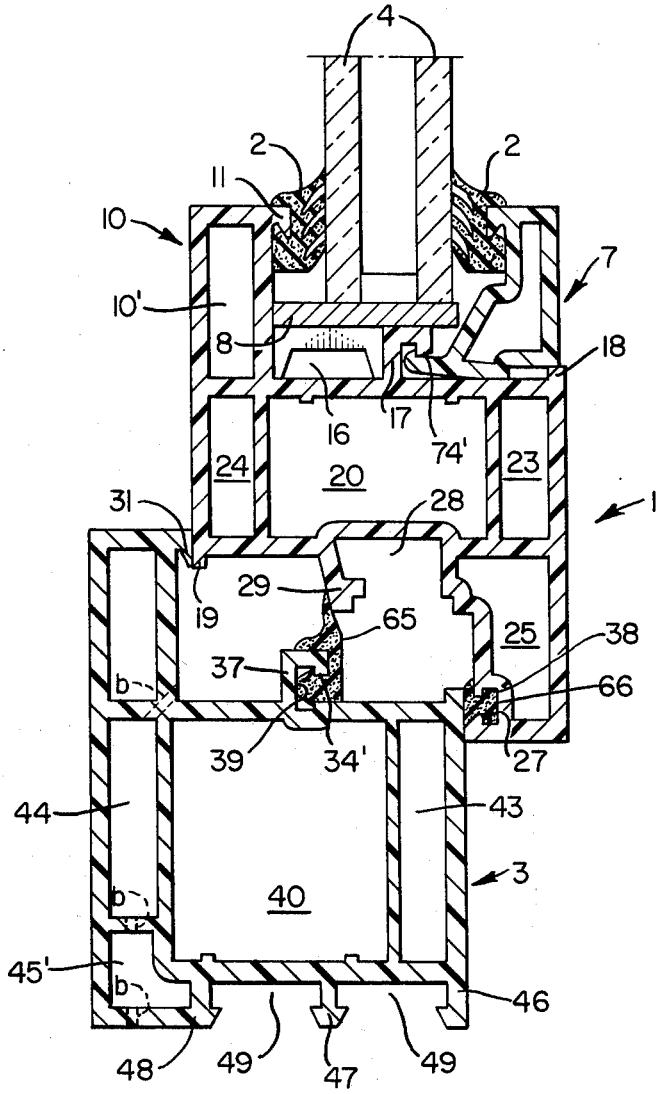

FIG. 8 is a cross-sectional view similar to FIG. 7 with the glass molding being fixed to the profile member; and FIG. 9 is a cross-sectional view through a window frame construction in accordance with the present invention with the profile member of FIG. 1 serving as the blind frame element and the profile member of FIG. 3 serving as the sash frame member for use in conjunction with the glass moldings of FIGS. 4–6.

Referring now to the drawings wherein like reference numerals are used throughout the various views to designate like parts and more particularly to FIG. 1 wherein a Z-shaped profile member generally designated by the reference numeral 1 is provided which is extruded, for example, from a thermoplastic synthetic resinous material such as a hard PVC. The Z-shaped profile member is of a hollow chamber cross-section and, for reinforcing purposes, metallic profile members (not shown) may be inserted in at least one of the hollow chambers; preferably, in the central or inner main chamber 20. By virtue of this construction, the same profile member size can be utilized for varying loads or stresses. The profile member 1 has on one side of the core cross-section a preferably centrally arranged tongue or projection 17. The tongue or projection 17 is twice angled at 13, 14 toward the outside so as to exhibit a substantially U-shaped configuration resulting in the formation of an undercut groove or recess 15. The free end 14' of the tongue 17 is preferably fashioned to be beveled or angled. The axis of symmetry of the profile member 1 extends through the middle of the tongue 17.

Laterally displaced from the free end 14' of the tongue 17, an abutment projection generally designated by the reference numeral 10 is fashioned on the profile member 1. The projection 10 includes a hollow chamber portion 10' with the exterior wall 10'' of the projection 10 being formed as an extension of the lateral wall or boundary of the profile member 1. The projection 10 may serve as either a glazing shoulder or as an abutment or contact tab depending on the manner in which the profile member 1 is utilized. A cam 11 is formed as an extension of an outer boundary of the wall portion 10''' with the cam 11 being directed inwardly toward the main chamber 20 and forming an undercut groove or recess 12. With a glazing arranged at the projection 10, the cam 11 functions as a receptor for a glass sealing element.

An open channel 16 is formed between the projection 10 and the tongue 17 and serves either as a drainage duct by way of bores *b* into the chamber 24 and from the chamber toward the outside of the profile member. Additionally, the open channel 16 may serve as a receiving channel for the insertion of shim profiles (not shown) for a glazing.

On the other side of the cross-section of the profile member 1, an outwardly projecting cam 18 is fashioned as an extension of the lateral wall or outer boundary of the profile member 1. The cam 18 may be provided with an inwardly directed undercut portion 18'. The cam 18 serves supporting functions for fittings and/or serves as a contact surface for a sealing means (not shown).

Depending on the respective requirements of the profile member 1, a central gasket (not shown) or a glass molding member can be introduced into the undercut groove 15 which is formed by the twice-angled tongue 17. It is also possible with the Z-shaped profile member 1 to form in opposition to the groove 15 a further groove (not shown) by recessing or indenting the wall 20' of the main chamber 20.

On each side of the main chamber 20 a lateral chamber 23 or 24 is provided which is separated from the main chamber by lateral webs 21, 22. The chamber 24 may serve as a drainage chamber in case of blind frames and sash profiles whereby the channel 16 is drained toward the outside by way of the bores *b.* The web 21 serves for the additional mounting of fittings (not shown) whereby the mechanical load-bearing capacity of the profile member 1 is increased.

A further abutment projection generally designated by the reference numeral 25 is provided on the profile member 1 diagonally opposite the abutment projection 10. The abutment projection 25 includes a hollow chamber portion 25' with the exterior wall 25'' of the projection 25 being formed as an extension of the lateral wall of the profile member 1. The abutment projection 25 is provided at its end with an inwardly oriented hammerhead-shaped groove 27 for receiving sealing elements and with a projecting cam portion 26.

A deep groove or recess 28 is arranged at the core cross-section of the profile member 1 adjoining the abutment projection for receiving fitting elements (not shown). The groove 28 is bounded on the other side thereof by an obliquely positioned contact cam 29. The contact cam 29 is inclined approximately 15° with respect to the vertical plane and serves to improve the contact engagement with a central seal (not shown). A water lug or drainage lug 19 is provided as a projecting cam on the outside of the Z-shaped profile member 1 at a position in opposition to the abutment projection 10.

Figure 2:
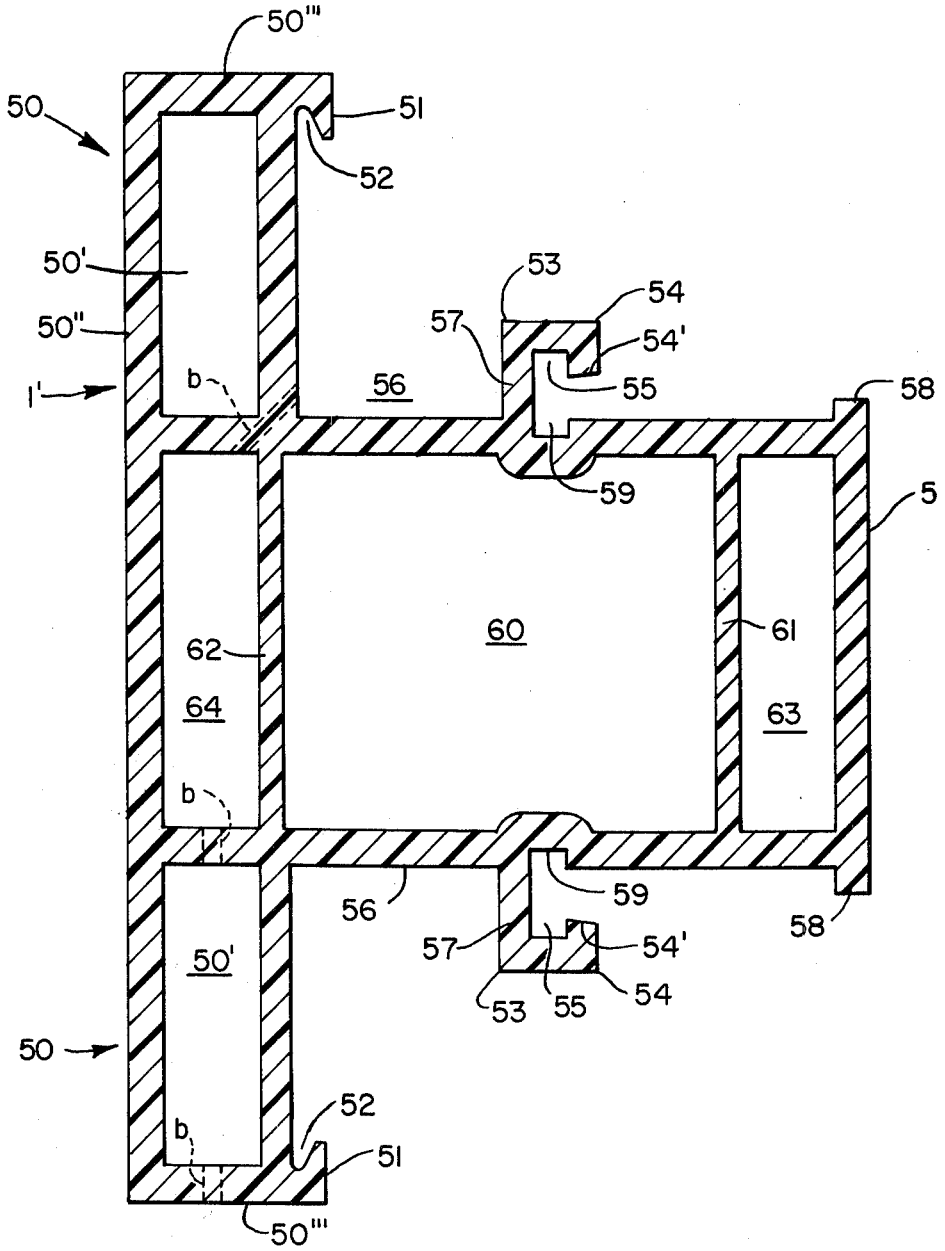
FIG. 2 is a cross-sectional view of a T-shaped profile member in accordance with the present invention.

As shown in FIG. 2, a profile member generally designated by the reference numeral 1' may be provided which has a T-shaped cross-sectional configuration. The profile member 1' is provided with symmetrically disposed projections generally designated by the reference numeral 50, tongues 57, and cams 58 on both sides of the core cross-section. The projections 50 each include a hollow chamber portion 50' with the exterior wall 50'' of each projection 50 being formed as an extension of a lateral wall or boundary of the profile member 1'.

A cam 51 is formed as an extension of an outer boundary or wall portion 50''' of each projection 50 with the cams 51 being directed inwardly toward a main chamber 60 and formed with undercut grooves or recesses 52. With a glazing arranged at the projections 50, the cams 51 function to receive a glass sealing profile member (not shown).

The tongue 57 is preferably centrally arranged on the profile member 1' and is twice angled at 53, 54 toward the outside so as to exhibit a substantially U-shaped configuration resulting in the formation of an undercut groove or recess 55. The free end 54' of the tongue 57 is preferably fashioned so as to be beveled or angled. The projection 50 may serve as either a glazing shoulder or as an abutment or contact tab depending upon the manner in which the profile member 1' is utilized.

A channel 56 is provided between each projection 50 and each tongue 57 with cams or projections 58 being formed as extensions of the lateral wall or boundary of the profile member 1'. As with the profile member 1, the channels 56 may serve as a drainage duct whereby water is directed from the channel 56 through bores *b* into chambers 64 and 50' and from there to the outside of the frame member and/or the channel 56 may serve as a receiving member for receiving shim profiles (not shown) for a glazing. The cams 58 serve a supporting function for fittings (not shown) and/or as a contact surface for a sealing means (not shown).

As readily apparent, the dimensions of the projections 50, cams 51, undercut grooves 52, tongues 57, undercut groove 55, channels 56, and projections 58 may correspond to the dimensions of the corresponding elements of the Z-shaped profile member 1. Furthermore, to increase the rigidity and reinforce the profile member 1', metallic profile elements may be provided and inserted in the hollow chambers preferably in the main chamber 60.

Additionally, the wall of the profile member 1' is recessed oppositely to the groove or recess 55 to form a further groove or recess 59 in the profile member. By this arrangement, a hammerhead-shaped large groove is provided wherein a central sealing profile element (not shown) can be anchored on both sides in a particularly advantageous manner. Moreover, it is also possible to anchor in the large groove a glass molding in correspondence with the Z-shaped profile member 1.

By virtue of the configuration of the T-shaped profile member 1', it is apparent that such profile member can be utilized as a blind frame profile as well as a sash profile. Furthermore, in the T-shaped profile member, the core cross-section is subdivided into a main chamber 60 and lateral chamber 63, 64 separated by webs 61, 62 with the webs 61, 62 and lateral chambers 63, 64 for filling analogous functions to those described in connection with the profile member 1 of FIG. 1.

As shown in FIG. 3, an L-shaped profile member generally designated by the reference numeral 3 is provided and is preferably utilized as a blind frame profile member. However, it is understood that the blind frame profile member can be glazed in exactly the same way as a sash profile according to FIGS. 1 or 2 whereby the glazing side of the L-shaped profile member 3 serves selectively as the contact side for a sash profile and can be equipped with a corresponding middle sealing element (not shown). The glazing side and/or the sealing side of the L-shaped profile member is formed, as in the case of the Z-shaped profile member 1 of FIG. 1 and/or the T-shaped profile member 1' of FIG. 2, with a projection generally designated by the reference numeral 30. The projection 30 is formed as an extension of the outer wall of the profile member 3. The projection 30 includes a hollow chamber portion 30' and a cam 31 formed on an extension of a wall thereof. The cam 31 is preferably provided with an undercut groove or recess 32. The profile member 3 has on one side of the core cross-section a preferably centrally arranged tongue or projection 37. The tongue or projection 37 is twice-angled at 33, 34 toward the outside so as to exhibit a substantially U-shaped configuration resulting in the formation of an undercut groove or recess 35. The free end 34' of the tongue or projection 37 is preferably angled or beveled. In the zone of the undercut groove or recess 35, a further groove or recess 39 is provided in the profile member 3 and is formed in the wall of the core cross-section by an indentation of the wall opposite the groove or recess 35. The grooves 35, 39 result in the formation of a hammerhead-shaped groove which serves for the bi-lateral anchoring of a central seal and/or for the insertion of a glass molding member.

A channel 36 is provided between the projection 30 and tongue 37 which channel serves for receiving shim profiles (not shown) for a glazing and/or as a drainage duct whereby water or the like is directed through bores *b* to the outside of the profile member 3.

Lateral chambers 43, 44 are provided and separated from the main chamber 40 by way of webs 41, 42. Snap-in or clip-in grooves 49 are provided on the side of the core cross-section of the profile member 3 opposite the tongue 37. The grooves 49 serve for receiving widening and auxiliary profiles. The grooves 49 are bounded by projecting hook-like cams or tongues 46, 47, 48. A corner projection generally designated by the reference numeral 45 is arranged as an extension of the lateral chamber 44 and forms an additional hollow chamber 45'. The cam 48 is formed as an extension of the outer wall 45" with the cam 46 being formed as a projection on an extension of an outer wall 43' of the lateral chamber 43. On the opposite end of the outer wall 43' a further cam 38 is provided having an undercut 38' which serves for receiving a seal element.

As shown in FIG. 4, a glass molding member generally designated by the reference numeral 7 is provided and consists, for example, of an extruded hard PVC profile member defining a closed hollow chamber 73. By fashioning the glass molding member 7 as a closed hollow profile member, the molding member has a high mechanical load bearing capacity even though the molding member may be of small dimensions which is of significance especially in situations wherein large panes are used and are exposed to high wind pressures.

The glass molding member 7 is provided with two projecting cams 71, 79 on the side thereof facing the glazing. The upper cam 71 is formed at a projection 77 of the profile member 7 and is provided with an undercut groove 72 for anchoring a sealing profile with the lower cam 79 serving as a holding cam. On the basal plane 200 of the glass molding member 7, which simultaneously constitutes the contact surface of the glass molding member 7 at the frame profile member, a tongue or projection 76 is formed. A slightly angled tongue or projection 78 is provided as an extension of the tongue 76. At the end of the tongue 78, a holding cam 79 is arranged. A bending point or elbow 75 is provided at the transitional area from the tongue 76 to the tongue 78. Preferably the angle $\alpha$ included between the tongue 78 and the basal plane 200 lies in the range of about 5° to 15°. However, it is understood that the angle $\alpha$ is dependent, in particular, on the dimensions of the glass molding members which are adapted to the dimensions of the glass panes to be inserted in conjunction with the associated frame profile members. Furthermore, the angle $\alpha$ is also dependent upon the length of the angled tongue 78 wherein the bending point or elbow 75 must be adapted to the glass molding member in each case so that a tipping or tilting moment, when the glass molding has been inserted into the frame profile member cannot occur thereby avoiding a loosening of the glass pane. The avoidance of the tipping or tilting movement is fulfilled in all cases when the space $d$ between the cam 71 and the glazing plane is less than the distance $d_1$ between the bending point or elbow 75 to the glazing plane. Preferably, the bending point or elbow 75 will be located at the core cross-section of the glass molding member; namely, in the zone of the chamber 73 of the molding member 7.

A shoulder 74 is formed at the tongue 76 on the side of the glass molding member 7 facing away from the glazing. However, the provision of the shoulder 74 at this zone is dependent upon the shape of the frame profile members in which the glass molding member 7 is to be inserted. Thus, it is possible to merely extend the tongue 76 up to the outer sidewall of the glass molding member 7 rather than form a shoulder 74.

The holding cam 79 on the angle tongue 78 is formed with a bevel at the front edge 191 to facilitate the introduction of the glass molding member 7 into the frame profile member. A barb or abutment 192 is provided at the front edge 191 whereby a hook-like engagement at the frame profile member can readily be accomplished. The height of the barb or abutment 192 determines the minimum spacing at which the holding cam 79 must be disposed from the basal plane 200 on the basis of the beveling of the tongue 78. The significance of this construction will become more apparent and will be explained in greater detail hereinbelow in connection with the arrangement of FIG. 7.

The glass molding member is generally designated by the reference numerals 7', 7'' and shown respectively in FIGS. 5 and 6 are of the same structure, in principle, as the glass molding member 7; however, the size of the glass molding 7', 7'', especially the size of the core cross section is different and the size of the main chambers 73', 73'' is dependent upon the thickness of the glazing presupposing a uniform frame profile member. The glass molding member 7' is utilized with normal glass pane while the molding member 7'' is utilized for insulated glass panes. It is especially advantageous in the glass molding members 7–7'' to form the cams 71, 79 facing the glazing as an extension of an outer wall and/or outer boundary of the respective glass molding profile members.

FIGS. 7 and 8 provide an illustrative example of assemblying the glass molding members and profile members in accordance with the present invention. While both figures depict the assembly of the Z-shaped profile member 1 and glass molding 7, it is understood that the T-shaped profile member 1' of the L-shaped profile member 3 and/or the glass molding members 7', 7'' could readily be assembled in an analogous manner. As indicated hereinabove, the profile member 1 and glass molding member 7 may consist, for example, of an extruded thermoplastic synthetic resin and may be provided with reinforcing metal inserts (not shown) for increasing the rigidity of the profile member 1. At the outer boundary of the glazing projection 10, the cam 11, facing the glazing, receives a seal or gasket 2 which is snapped or clipped on. At the core profile of the frame profile member 1, the centrally arranged doubly angled tongue 17 is bent toward the outside away from the glazing form. As apparent from FIG. 4, the angle or beveled end 14' of the tongue 17 facilitates the insertion of the holding cam 79 of the glass molding 7.

In the open channel or groove 16 formed between the glazing projection 10 and the tongue 17 support blocks or chocks 6 are inserted at spaced intervals and supporting wedges 8 are provided which carry the insulated glazing 4 and which rest on the blocks 6. Since, in the illustrated example of FIGS. 7 and 8, an insulated glazing 4 having a large glazing thickness is provided, it is necessary to enlarge the mounting base for the insulated glazing by means of the supporting wedges 8.

The insulated glazing 4 is fixed in place by inserting the tongue 78 of the glass molding 7 into the groove 15 in parallel to the frame. The insertion is accomplished by virtue of the fact that the holding cam 79 of the obliquely extended tongue 78 of the glass molding 7 slides along the beveled end 14' of the tongue 17 of the frame profile member 1 until it engages behind the angled end 14' with the abutment or barb 192 thereby firmly hooking the molding 7 to the profile member 1. At the same time, the cam 71, provided with a seal 2 snapped or clipped in groove 72 is pressed against the glazing 4 thereby producing a glazing pressure whereby the tongue 76 is brought into flush contact with the wall 20' of the profile member 1 and whereby a simultaneous securing of the hook-like engagement of the holding cam 79 at the angled tongue 17 is effected.

A tilting and/or loosening of the glass molding 7 is impossible since the insulated glazing 4 exerts a constant pressure on the glass molding 7. Since, in the illustrated example, the frame profile member 1 is formed on the side oppositely to the glazing projection with a projection 18, it is necessary that the glass molding 7 be fashioned with the shoulder 74 which slides over the tongue 18 and, after fixation of the glass molding 7 is firmly engaged at the tongue 18.

The space 9 between the holding cam 79 and contact surface of the frame profile member 1 remaining after the glass molding 7 has been inserted in the frame profile member 1 must correspond at least to the height of the abutment 192 of the holding cam 79 in order to make it possible to correspondingly introduce the holding cam 79 into the groove or recess 15. The side walls of the glass molding 7, not shown in detail, are preferably dimensioned so that the required rigidity and strength are provided; however, it is also possible to fashion the individual side walls with differing wall thicknesses and, for example, also to make the angled tongue 17 of a thinner wall thickness than the other side walls.

If the frame profile member 1 is not provided with a projecting cam 18, it is understood that the glass molding 7 then need not be formed with the shoulder 74 but rather the tongue 76 may extend without a shoulder to the outer side wall of the glass molding member 7. However, a configuration of the glass molding member 7 having a favorable effect on the mechanical strength is provided by the bend or elbow 75 of the tongue 76 with the provided shoulder 74 and with the bending point 75 being located in the zone of the chamber 73.

FIG. 9 provides an illustrative example of an assembled frame installation employing the profile members 1, 3 and the glass molding member 7 of the present invention. As shown in FIG. 9, the projection 10 of the Z-shaped profile member 1 serves as the glazing projection with a sealing element 2 being snapped or clipped in the undercut groove 12 formed at the cam 11. Suitable support blocks 6 are disposed in the channel 16 formed between the tongue 17 and the projection 10 with the wedge shaped support elements 8 being employed to accommodate an insulated glazing 4. The tongue 78 of the glass molding member 7 is inserted into the space 15 formed by the tongue 17 and securely fixes the molding member 7 to the profile member 1. A further sealing element 2 is snapped on the cam 71 at the undercut groove 72.

An elastic sealing element 66 is inserted in the groove 27 provided at the abutment projection 25 and rests on the projecting tongue 38 of the profile member 3 which serves as a blind profile member in the assembly. The elastic sealing element 66 serves to seal the gap at the transitional area between the sash frame member formed by the profile member 1 and the profile member 3.

The central groove 28 formed in the profile member 1 on the side thereof opposite the glazing accommodates fittings (not shown) therein. The inclination of the contact cam 29 is advantageous since the cam provides a contact surface for one end of a central seal 65, the other end of the seal 65 being snapped onto the tongue 37 of the profile member 3. The drip of drainage lug 19 is disposed in abutting relationship with the end wall surface of the cam 31 of the profile member 3 whereby any water is directed from the lug 19 into the channel or groove 36 formed between the tongue 37 and the projection 30 and from the channel 36 through bores 5 and chambers 44, 45' to the outside of the frame assembly.

As apparent from FIG. 9, each of the profile members 1, 3 may be additionally reinforced by providing metallic profile inserts (not shown) in at least the inner or main chambers 20, 40. Furthermore, depending upon the required load bearing capacity of the L-shaped profile member 3, the chambers 40, 43 may either be formed larger or smaller. Additionally, since the L-shaped profile member is provided with the tongue 37 and cam 31 on one side thereof, such profile member 3 cannot only be utilized to accommodate the central seal 65 but can also serve to mount the glazing by providing an appropriate sealing element 2 in the undercut 32 and securing a molding glass profile member 7–7" to the profile member 3 by way of the projecting tongue 37 with the only prerequisite being that the tongue 37 is preferably arranged centrally of the side of the profile member 3.

As noted hereinabove, the Z-shaped profile member 1 can serve as a sash profile member, blind frame member and also for mounting a glazing with the L-shaped profile member serving as a blind frame profile member; however, the L-shaped profile member is fashioned so that it also can receive a fixed glazing. The T-shaped profile member 1' can be utilized as a blind frame member, sash frame member and/or as an abutment profile member or positioning element. All of the frame profile members 1, 1', 3 are distinguished in that in case of the blind frame member and the sash member, the mutually averted sides, namely, the blind frame side in contact with the sash member and the glazing side of the sash member, are formed anagolously so that they can receive the same single glass molding member.

The projecting cams 11, 31 with the undercut grooves or recesses 12, 32 for receiving the sealing means are formed at the end of the projection serving as the glazing projection of the Z-shaped profile member 1 as well as of the L-shaped profile member 3. Furthermore, on the side of each of the profile members the tongues 17, 37, 57 are centrally arranged to form the grooves 15, 35, 55 for receiving the projecting tongues of the glass moldings 7–7". When the L-shaped profile member 3 is to be used as a blind frame member, the wall of the profile member 3 is indented in the oppositely located zone of the groove or recess 15 so that in addition of a glass molding member a sealing profile is provided which can serve as the middle seal 65 between the blind frame 3 and sash 1.

All of the profile members 1, 1', 3 are fashioned so that, in the core cross-section, the main chamber 20, 40, 60 is bounded toward the lateral sides by further chambers with the outer chambers facing the weather side serving for the purposes of drainage. The other lateral chambers facing the inside of the room fulfill the purpose of providing that the webs separating these chambers from the respective main chambers serve for the additional mounting of fittings thereby increasing the strength and load bearing capacity of the respective profile members.

The profile arrangement with T-shaped, Z-shaped and L-shaped profile members avoids the disadvantages encountered in the prior art by providing a preferably centrally arranged twice-angled tongue which extends away from the glazing for receiving a tongue of the glass molding and lockingly engaging the glass molding to the frame. At the same time the tongue serves, in connection with a blind frame profile member, for anchoring a central seal. Furthermore, the projections of the profile members on the side carrying the tongue additionally serve to receive a sealing profile for the glazing. Thus, it is possible to form blind frame profile members and sash frame profile members for serving differing functions wherein the mutually averted sides of the blind frame profile members and/or sash profile member, namely, the blind frame profile side in contact with the sash profile and, in case of the sash profile, the glazing side, are formed identically so that they can always be provided with a glazing. Moreover, the blind frame profile member is formed in each case in accordance with the present invention so that the structure receiving the glass molding can selectively be utilized for receiving a central sealing means. Furthermore, a closed glass molding member is provided and utilized with the profile members of the present invention resulting in an advantageous construction since the glass molding is introduced in parallel to the core cross-section of the respective profile members and is firmly mounted in place by hook-like engagement.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A frame arrangement, especially for doorframe and window frame construction comprising:

a profile member of hollow cross-sectional configuration formed by a plurality of interconnected side walls which surround and enclose a hollow space, at least one outwardly projecting tongue means disposed on at least one side wall of the profile member at the center thereof for receiving at least one of a glass molding means and a sealing means, said tongue means includes a first portion extending outwardly from the side wall of said profile member, a second portion extending outwardly from said first portion substantially parallel to the side wall of said profile member and spaced therefrom, and a third portion extending from a second wall portion toward the side wall of said profile member, said third portion terminating in a free end spaced from the side wall of said profile member, said first, said second and said third portions defining a groove therebetween for receiving at least one of the glass molding means and the sealing means, said profile member includes a projecting portion extending from the side wall on which said tongue means is disposed, said projecting portion being of hollow cross-sectional configuration formed by a plurality of interconnected side walls which surround and enclose a hollow space, said projecting portion being spaced from said tongue means and defining a channel between said first portion of said tongue means and a side wall of said projecting portion, a cam means arranged on an extension of a side wall of said projecting portion, said cam means being directed toward the side wall of said profile member on which said tongue means is disposed and defining a groove means for accommodating a sealing element, a recess means provided on the side wall of said profile member on which said tongue means is disposed, said recess means beind disposed in alignment with said groove defined by said tongue means, and at least a pair of web means disposed in the hollow space enclosed by the side walls of said profile member, said web means being spaced from each other and the side walls of the profile member such that the profile member includes a main chamber and lateral chambers disposed on each side of said main chamber, one of said lateral chambers accommodating the mounting of additional fittings, the other of said lateral chambers draining fluid from said channel.

2. An arrangement according to claim 1, wherein said recess and said groove define a hammerhead-shaped opening for accommodating a sealing element.

3. An arrangement according to claim 1, wherein a holding cam is provided on said profile member on the side thereof on which said tongue means is disposed, said holding cam being formed as an extension of a side wall of said profile member disposed opposite said projecting portion.

4. An arrangement according to claim 3, wherein said holding cam includes an undercut groove portion.

5. An arrangement according to claim 4, wherein a further projecting portion is provided extending from a side wall of said profile member disposed oppositely from the side wall on which said tongue means is disposed, said further projecting portion being a hollow cross-sectional configuration formed by a plurality of interconnected side walls which surround and enclose a hollow space, said further projecting portion being provided on said profile member at a position thereon diagonally opposite the first projection portion such that said profile member has a substantially Z-shape cross-sectional configuration with said main chamber and said lateral chambers defining the body of the Z-shape and the projecting portion and further projecting portion defining the respective lateral ends of the Z-shape.

6. An arrangement according to claim 5, wherein a contact cam is provided on a side of said profile member from which said further projecting portion extends, said contact cam being spaced from a side wall of said further projecting portion and defining a channel means for receiving additional fittings.

7. An arrangement according to claim 6, wherein said profile member is a sash profile member.

8. An arrangement according to claim 6, wherein said profile member is a blind frame profile member.

9. An arrangement according to claim 4, wherein a further projecting portion is provided extending from a side wall of said profile member disposed oppositely from the side wall on which said tongue means is disposed, said further projecting portion being of a hollow cross-sectional configuration formed by a plurality of interconnected side walls which surround and enclose a hollow space, said further projecting portion being provided on said profile member at a position thereon in alignment with the first projecting portion such that said profile member has a substantially T-shaped cross-sectional configuration with said main chambers and said lateral chambers forming the stem of the T-shape and said projecting portion and said further projecting portion forming extensions of the T-shape from the stem.

10. An arrangement according to claim 9, wherein said profile member is a blind frame member.

11. An arrangement according to claim 9, wherein said profile member is a sash frame member.

12. An arrangement according to claim 9, wherein said profile member is a positioning element.

13. An arrangement according to claim 9, wherein said profile member is a supporting element.

14. An arrangement according to claim 9, wherein a further cam means is provided and arranged on an extension of a side wall of said further projecting portion, said cam means being directed toward the side wall of said profile member from which said further projecting portion extends and defines a groove means for accommodating a sealing element.

15. An arrangement according to claim 14, wherein a further tongue means is provided on said profile member, said further tongue means being disposed on the side wall of said profile member from which said further projecting portion extends.

16. An arrangement according to claim 15, wherein said further tongue means includes a first portion extending outwardly from the side wall of said profile member, a second portion extending outwardly from said first portion substantially parallel to the side wall of said profile member and spaced therefrom, and a third portion extending from said second portion toward the side wall of said profile member, said third portion terminating in a free end spaced from the side wall of said profile member, said first, said second, and said third portions defining a groove therebetween for receiving at least one of a glass molding means and a sealing means.

17. An arrangement according to claim 16, wherein said further tongue means is spaced from said further projecting portion and defines a channel between said first portion of said further tongue means and a side wall of said further projecting portion.

18. An arrangement according to claim 17, further comprising a glass molding means for fixing a glass pane to said profile member, said glass molding means including means for selectively engaging one of said tongue means provided on said profile member.

19. An arrangement according to claim 18, wherein said means for engaging includes an outwardly extending tongue portion and a holding cam provided on said tongue portion and received in said groove of one of said tongue means of said profile member.

20. An arrangement according to claim 19, wherein said glass molding means includes a contact surface for engaging a side wall of said profile member on which said tongue means are disposed, said tongue portion of said glass molding means extending upwardly at an angle from said contact surface.

21. An arrangement according to claim 20, wherein said angle lies in the range of 5° to 15°.

22. An arrangement according to claim 21, wherein said holding cam on said glass molding means includes a locking abutment, said holding cam on said glass molding means being spaced from a plane in which said contact surface is disposed by a distance at least equal to the height of said locking abutment.

23. An arrangement according to claim 22, wherein said holding cam on said glass molding means is spaced at a distance greater than the height of said locking abutment.

24. An arrangement according to claim 20, wherein said glass molding means consists of a profile element of hollow cross-sectional configuration formed by a plurality of interconnected side walls which surround and enclose a hollow space to define a closed chamber.

25. An arrangement according to claim 24, wherein said outwardly extending tongue portion of said glass molding means is formed as an extension of a side wall thereof, said tongue portion of said glass molding means projecting laterally beyond said chamber of said glass molding means.

26. An arrangement according to claim 25, wherein a transition area from the side wall of said glass molding means to said tongue portion thereof is disposed in a zone of said chamber of said glass molding means.

27. An arrangement according to claim 26, wherein a seal mounting cam is provided on a side of said glass molding means facing a glass pane.

28. An arrangement according to claim 27, wherein said seal mounting cam is formed as an extension of a side wall of said glass molding means disposed oppositely of the side wall upon which said tongue portion is provided.

29. An arrangement according to claim 28, wherein said seal mounting cam is spaced from the pane of glass by a distance which is less than the distance between the transition area and the pane of glass.

30. An arrangement according to claim 29, wherein the free ends of said tongue means and said holding cam on said glass molding means are provided with rounded edges.

31. An arrangement according to claim 29, wherein the free ends of said tongue means and said holding cam on said glass molding means are provided with beveled edges.

32. An arrangement according to claim 1, wherein a further projecting portion is provided extending from a side wall of said profile member disposed oppositely from the side wall on which said tongue means is disposed, said further projecting portion being of a hollow cross-sectional configuration formed by a plurality of interconnected side walls which surround and enclose a hollow space, said further projecting portion being provided on said profile member at a position thereon diagonally opposite said first projecting portion such that said profile member has a substantially Z-shaped cross-sectional configuration.

33. An arrangement according to claim 32, further comprising a glass molding means for fixing a glass pane to said profile member, said glass molding means including means for selectively engaging said tongue means provided on said profile member.

34. An arrangement according to claim 33, wherein said means for engaging includes an outwardly extending tongue portion and a holding cam provided on said tongue portion received in said groove defined by said tongue means of said profile member.

35. An arrangement according to claim 24, wherein said glass molding means consists of a profile element of hollow cross-sectional configuration formed by a plurality of interconnected side walls which surround and enclose a hollow space to define a closed chamber.

36. An arrangement according to claim 35, wherein said profile member and said glass molding means are extruded from a thermoplastic synthetic resinous material.

37. An arrangement according to claim 1, wherein a further projecting portion is provided extending from a side wall of said profile member disposed oppositely from the side wall on which said tongue means is disposed, said further projecting portion being of a hollow cross-sectional configuration formed by a plurality of interconnected side walls which surround and enclose a hollow space, said further projecting portion being provided on said profile member at a position thereon in alignment with the first projecting portion such that said profile member has a substantially T-shaped cross-sectional configuration.

38. An arrangement according to claim 37, further comprising a glass molding means for fixing a glass pane to said profile member, said glass molding means including means for selectively engaging said tongue means provided on said profile member.

39. An arrangement according to claim 38, wherein said means for engaging includes an outwardly extending tongue portion and a holding cam provided on said tongue portion received in said groove defined by said tongue means on said profile member.

40. An arrangement according to claim 39, wherein said glass molding means consists of a profile element of hollow cross-sectional configuration formed by a plurality of interconnected side walls which surround and enclose a hollow space to define a closed chamber.

41. An arrangement according to claim 40, wherein a further tongue means is provided on said profile member, said further tongue means being disposed on the side wall of said profile member from which said further projecting portion extends.

42. An arrangement according to claim 41, wherein said further tongue means includes a first portion extending outwardly from the side wall of said profile member, a second portion extending outwardly from said first portion substantially parallel to the side wall of said profile member and spaced therefrom, and a third portion extending from said second portion toward the side wall of said profile member, said third portion terminating in a free end spaced from said side wall of said profile member, said first, second, and third portions of said further tongue means defining a further groove therebetween for receiving a sealing means.

43. An arrangement according to claim 1, further comprising a further profile member of hollow cross-sectional configuration formed by a plurality of interconnected side walls which surround and enclose a hollow space, and at least one outwardly projecting tongue means provided on at least one side wall of said further profile member for receiving a sealing means.

44. An arrangement according to claim 43, wherein the first-mentioned profile member includes a second projecting portion extending from a side wall of said profile member disposed oppositely from the side wall on which said tongue means is disposed, said second projecting portions of said first-mentioned profile member being of a hollow cross-sectional configuration formed by a plurality of interconnected side walls which surround and enclose a hollow space, said second projecting portion of said first-mentioned profile member including a cam means formed as an extension of a side wall thereof for accommodating a sealing means, said projecting portions of said first-mentioned profile member being disposed at diagonally opposite positions of said profile member such that said profile member has a substantially Z-shaped cross-sectional configuration.

45. An arrangement according to claim 44, wherein said further profile member includes a projecting portion extending from the side wall of the profile member on which the tongue means is disposed, said projecting portion being of a hollow cross-sectional configuration formed by a plurality of interconnected side walls which surround and enclose a hollow space, a cam means is arranged on an extension of a side wall of said projecting portion of said further profile member, said cam means on said projecting portion of said further profile member including an end surface which abuttingly engages a side wall of the first mentioned profile member.

46. An arrangement according to claim 45, wherein said second projecting portion of the first mentioned profile member includes a hammerhead-shaped groove means for accommodating a sealing means.

47. An arrangement according to claim 46, wherein a sealing means is disposed in said hammerhead-shaped groove means, said further profile member being provided with a cam portion formed as an extension of a side wall thereof, said cam portion sealingly engaging said sealing means disposed in said hammerhead-shaped groove means.

48. An arrangement according to claim 47, wherein the first mentioned profile means includes a contact cam provided on the side wall thereof from which said second projecting portion extends, said contact cam being spaced from said second projecting portion and defining with a wall of said second projecting portion a channel for receiving fitting elements, said tongue means on said further profile member being provided with a groove for receiving a sealing element, a sealing element having one end thereof disposed in said groove of said tongue means with the other end of said sealing element slidingly engaging a surface of said contact cam.

49. An arrangement according to claim 48, further comprising a glass molding means for fixing a glass pane to the first mentioned profile member, said glass molding means including means for selectively engaging said tongue means provided on said first mentioned profile member.

50. An arrangement according to claim 1, further comprising a glass molding means for fixing a glass pane to said profile member, said glass molding means including means for selectively engaging said tongue means provided on said profile member.

51. An arrangement according to claim 50, wherein said glass molding means consists of a profile element of hollow cross-sectional configuration formed by a plurality of interconnected side walls which surround and enclose a hollow space to define a closed chamber.

52. An arrangement according to claim 51, wherein said tongue means includes a groove, said means for engaging includes an outwardly extending tongue portion and a holding cam provided on said tongue portion received in said groove of said tongue means of said profile member.

53. An arrangement according to claim 49, wherein said means for selectively engaging said tongue means includes an outwardly extending tongue portion and a holding cam provided on said tongue portion and received in the groove of said first-mentioned profile member.

54. An arrangement according to claim 53, wherein said glass molding means includes a contact surface for engaging a side wall of said first-mentioned profile member on which the tongue of the profile member is provided, said tongue portion of said glass molding means extending upwardly at an angle from said contact surface.

55. An arrangement according to claim 54, wherein said angle lies in the range of 5° to 15°.

56. An arrangement according to claim 55, wherein said holding cam on said glass molding means includes a locking abutment, said holding cam on said glass molding means being spaced from a plane in which said contact surface is disposed by a distance at least equal to the height of said locking abutment.

57. An arrangement according to claim 56, wherein said holding cam on said glass molding means is spaced at a distance greater than the height of said locking abutment.

58. An arrangement according to claim 54, wherein said glass molding means consists of a profile element of hollow cross-sectional configuration formed by a plurality of interconnected side walls which surround and enclose a hollow space to define a closed chamber.

59. An arrangement according to claim 58, wherein said outwardly extending tongue portion of said glass molding means is formed as an extension of a side wall thereof, said tongue portion of said glass molding means projecting laterally beyond said chamber of said glass molding means.

60. An arrangement according to claim 59, wherein a transition area from the side wall of said glass molding means to said tongue portion thereof is disposed in a zone of said chamber of said glass molding means.

61. An arrangement according to claim 60, wherein a seal mounting cam is provided on a side of said glass molding means facing a glass pane.

62. An arrangement according to claim 61, wherein said seal mounting cam is formed as an extension of a side wall of said glass molding means disposed oppositely of the side wall upon which said tongue portion is provided.

63. An arrangement according to claim 62, wherein said seal mounting cam is spaced from the pane of glass by a distance which is less than the distance between the transition area and the pane of glass.

64. An arrangement according to claim 63, wherein the free ends of said tongue means and said holding cam on said glass molding means are provided with rounded edges.

65. An arrangement according to claim 64, wherein said angle lies in the range of 5° to 15°.

66. An arrangement according to claim 63, wherein the free ends of said tongue means and said holding cam on said glass molding means are provided with beveled edges.

67. An arrangement according to claim 66, wherein said angle lies in the range of 5° to 15°.

* * * * *